United States Patent [19]

Bleloch

[11] 4,022,612

[45] May 10, 1977

[54] PRODUCTION OF ALLOYS OF IRON

[75] Inventor: William Bleloch, Johannesburg, South Africa

[73] Assignee: Electroheat (Proprietary) Limited, Johannesburg, South Africa

[22] Filed: Nov. 6, 1975

[21] Appl. No.: 629,538

[30] Foreign Application Priority Data

Nov. 12, 1974 South Africa ..... 74/7231

[52] U.S. Cl. ..... 75/12; 13/9 R; 75/59; 75/60

[51] Int. Cl.[2] ..... H05B 7/18; C21C 5/52; C21C 5/28

[58] Field of Search ..... 75/10, 11, 12, 60, 59; 13/9

[56] References Cited

UNITED STATES PATENTS 3,615,349 10/1971 Bleloch ..... 75/12

3,708,599 1/1973 Krause ..... 13/9

*Primary Examiner*—P. D. Rosenberg

*Attorney, Agent, or Firm*—Stevens, Davis, Miller & Mosher

[57] ABSTRACT

The invention relates to the removal of carbon from ferrous metals to reduce the carbon content to a very low proportion by preparing a molten superheated bath of ferrous metal in an oxygen converter, oxygen blowing this bath in conventional manner to partially remove the carbon from the metal and thereafter subjecting the metal to a hign velocity high temperature water vapor flame jet, allowing the stable volatile carbon compounds resulting therefrom to separate from the metal and then removing the metal from the bath. The water vapor jet will be formed by the reaction of hydrogen and oxygen at the jetting orifice of a converter lance and will have a carbon oxides content of less than 1 volume percent.

10 Claims, No Drawings

PRODUCTION OF ALLOYS OF IRON

BACKGROUND OF THE INVENTION

This invention relates to the separation and removal of carbon from iron and alloy steels and ferro-alloys especially those containing chromium and vanadium, hereinafter referred to as ferrous metals, so that a predetermined composition of metal can be obtained.

In my earlier U.S. Pat. No. 3,615,349 there is described a process for removing carbon from ferrous metals but that invention describes essentially a process which requires the use of an alternating or direct current arc plasma torch and the generation and supply of water vapor obtained separately and fed to this torch. It was considered essential that this separate water vapor supply be obtained.

GENERAL PURPOSE OF THE INVENTION

It is an object of this invention to provide a process for the removal of carbon from ferrous metals, especially those containing chromium and vanadium, having carbon levels in the initial ferrous metal of the order of 6 percent or higher to levels below 0.05 percent.

According to this invention there is provided a process for the removal of carbon from ferrous metals comprising:

a. the preparation of a molten superheated bath of ferrous metal in an oxygen converter;
b. oxygen blowing this bath in conventional manner to partially remove the carbon from the metal;
c. thereafter treating the metal with a high velocity high temperature water vapor flame jet;
d. allowing the stable volatile carbon compounds formed to separate from the metal.

The invention also provides for the water vapor flame jet to be formed by the reaction of hydrogen and oxygen at the jetting orifice of a normal converter lance and for this to be effected by conveying hydrogen in a pipe installed in the oxygen channel of the lance, preferably with the pipe co-axial with said channel.

Still further features of this invention provide for the jet to be substantially entirely water vapor; or a mixture substantially of oxygen and water vapor; or a mixture of oxygen, nitrogen and water vapor; any such mixture containing less than 1 volume percent of carbon oxides; and for the proportion of free oxygen in the flame jet to be between zero and approximately 60 percent by volume, the value depending on the stage of carbon removal and the composition of the steel in the converter.

The invention still further provides that the converter be of the top blown, Linz-Donawitz type.

A. In one practical example, the operation of this process is envisaged to be as follows hereafter, the description of the operation being based in this example on carbon removal from a 30 ton charge of ferrous metal composed of 15 tons of A.I.S.I. 403 stainless steel scrap containing 0.12% carbon, 0.25% silicon and 17.5% chromium; 4.9 tons of high-carbon ferrochromium containing 58% chromium, 6.1% carbon and 3.6% silicon; 10.5 tons of mild steel scrap containing 0.40% carbon and 0.45% silicon and 150 kg. of nominal 75% ferrosilicon.

This 30 ton charge of ferrous metal would be melted in a 35 ton capacity steel melting furnace and superheated to approximately 1650° C to give a molten bath containing 18.2% of chromium, 0.86% carbon (allowing for carbon pick-up from the graphite electrodes) and 0.88% silicon (allowing for oxidation of sillicon).

The molten and superheated ferrous metal would be transferred by ladle crane to a previously heated basic refractory lined oxygen converter of the L.D. type equipped with an oxygen lance having a central pipe in the oxygen channel to convey hydrogen to the lance head. The annular oxygen channel in the lance would be designed to deliver up to 85nm$^3$ oxygen per minute and the central hydrogen pipe in the annular oxygen channel would be designed to deliver up to 85nm$^3$ of hydrogen per minute. Oxygen would be supplied from a conventional air separation source and from a standard type of high pressure water electrolysis plant equipped with high pressure storage for oxygen and for hydrogen, both of which would be supplied to the converter lance through appropriate control valves, non-return valves and flow meters to be used as required in the converter operation.

After emplacement in the converter, the charge would be blown with oxygen as in normal converter practice to about 0.4% carbon content and silicon below 0.1%, and slag removed from the metal if required and the oxygen blowing resumed. Thereafter hydrogen would be passed into the central lance pipe and would ignite in the oxygen stream at the lance jetting orifice to form the oxy-hydrogen flame jet which would have at the operating lance orifice height above the metal a velocity sufficient to penetrate the metal bath to approximately the same depth as the previous oxygen jet. The oxy-hydrogen flame jet would be adjusted by appropriate valve controls to have initially approximately 30% oxygen in excess of the stoichiometric quantity required to form water vapor, the excess oxygen being increased or decreased if required during the blowing operation. Blowing would be continued until the carbon of the charge had been removed to the desired level. Initial oxygen blowing is expected to last 9–10 minutes for this charge of ferrous metal and the oxy-hydrogen flame jet blowing is expected to last less than 15 minutes.

Composition of the final metal is expected to be 17.4% chromium and less than 100 ppm carbon. The final metal made with basic refractories would normally contain more than 6 ppm of hydrogen and would thus require degassing under vacuum by conventional means or by purging with argon, using for that purpose, for example, approximately 1 nm$^3$ of argon per ton of finished metal prior to tapping.

B. As a second practical example, the operation of this process is envisaged to be essentially as that detailed in the first cited practical example above, both in quantities and procedure excepting that the converter would be lined with any standard grade of converter acid refractory such as ganister, chamotte or the like and the process would be operated with an acid slag. Under these conditions the final metal of the specification cited in the first example would not require to be subjected to vacuum degassing and/or purging by argon but would be cast directly into ingots or otherwise as required, and the difficulties in operation caused by slag foaming and slopping would be greatly diminished.

C. As a third practical example, the operation of this process in the production of pearlite-free vanadium steel of very low transition temperature and high resistance to strain-aging for use in the construction, for example, of long distance pipe-lines and as automotive sheet is envisaged to be as follows:

The operation would be for the purpose of carbon removal from a 100 ton charge of ferrous metal composed of 22 tons of vanadium pig-iron containing 4.2% carbon, 0.6% silicon, 0.3% of phosphorus and 1.4% of vanadium, 77 tons of blown metal of carbon equivalent 0.4% and 0.4% of phosphorus, and 0.75 tons of 75% ferrosilicon.

This 100 ton charge of ferrous metal would be melted in a 100-ton capacity steel-melting arc furnace and superheated to approximately 1650° C to give a molten bath containing 0.3% vanadium and a carbon equivalent of approximately 2% allowing for carbon pick-up and partial oxidation of silicon during melting and superheating.

The molten and superheated ferrous metal would be transferred by ladle to a previously heated acid-lined oxygen converter of the L.D. type equipped with an oxygen lance fitted with a central pipe in the oxygen channel to convey hydrogen to the lance head. The annular oxygen channel in the lance would be designed to deliver up to 140 $nm^3$ oxygen per minute and the central hydrogen pipe in the annular oxygen channel would be designed to deliver up to 140 $nm^3$ hydrogen per minute. Oxygen would be supplied from a conventional air separation source and from a standard type of high pressure water electrolysis plant equipped with high pressure storage for oxygen and for hydrogen, both of which would be supplied to the converter lance through appropriate control valves to be used as required in the converter operation.

On emplacement in the converter the charge would be blown with oxygen as in normal converter practice to about 0.4% carbon content and silicon below 0.1% and slag removed from the metal if required. Thereafter hydrogen would be passed into the central lance pipe and would ignite in the oxygen stream at the lance jetting orifice to form the oxy-hydrogen flame jet which would have a height above the metal bath and a velocity designed to penetrate into the metal bath to approximately the same depth as the previous oxygen jet. The oxy-hydrogen flame jet would be adjusted by appropriate valve controls to have initially approximately 30 percent oxygen in excess of the stoichiometric quantity required to form water vapor. Blowing would be continued until the carbon of the charge had been removed to the desired level. Initial oxygen blowing is expected to last approximately 10 minutes for this charge of ferrous metal and the oxy-hydrogen flame jet blowing is expected to last less than 15 minutes.

The final metal is expected to contain less than 0.01% of carbon, 0.28% of vanadium, and less than 3 ppm of hydrogen. The metal would be expected to have a transition temperature of the order of minus 80° C and would normally be cast without vacuum degassing and/or argon purging for hydrogen removal.

The hydrogen required for this process may be obtained from any convenient source but it is considered that in normal circumstances the hydrogen is best obtained from the standard, well-developed and reliable electrolytic plant which would yield the important by-product of deuterium-enriched water.

It will be apparent to those versed in the art that the lance orifices may be single or multiple and of the convergent-divergent type if desired and the access channel or channels to them would preferably be water cooled and preferably constructed of copper and that the oxy-hydrogen gas stream through these passages would have a designed velocity sufficient to prevent ignition in the lance channels in normal operational conditions.

It will also be apparent to those versed in the art that nitrogen may be introduced into the water vapor flame plasma jet as hereinbefore defined, as such or as a constituent of air, in appropriate quantities should it be required as an alloying element, as in certain low-carbon chromium steels, and in certain grades of low-carbon austenitic manganese steels. Also, where desired the hydrogen may be passed through the lance channel and oxygen through the central pipe.

Experimental use ofthe process has shown that the oxygen and hydrogen may be mixed at the top of a normal converter type lance and be ignited at the jetting orifice. None of the experimental use has shown any tendency for the mixture to ignite anywhere other than at the jetting orifice but it is preferred that the hydrogen be conveyed to the jetting orifice through a central separate pipe in the lance.

What I claim as new and desire to secure by Letters Patent is:

1. A process for the removal of carbon from ferrous metals comprising:

a. the preparation of a molten superheated bath of ferrous metal in an oxygen converter;

b. generating high velocity streams of hydrogen and oxygen such that water vapor is formed externally of a converter lance by the reaction of hydrogen and oxygen issuing at high velocity from said lance and such that a water vapor flame jet is formed;

c. treating the metal with said water vapor flame jet; and d. allowing the stable volatile carbon compounds formed to separate from the metal.

2. A process as claimed in claim 1 in which the water vapor flame jet is formed by the reaction of hydrogen and oxygen at the jetting orifice of a converter lance in which the hydrogen is conveyed to the jetting orifice via a pipe installed in the oxygen channel of the lance, with the pipe substantially co-axial with said channel.

3. A process as claimed in claim 2 in which the oxygen is conveyed to the jetting orifice via a pipe installed in a hydrogen channel in the lance with the pipe substantially co-axial with said channel.

4. A process as claimed in claim 1 in which the flame jet is substantially entirely water vapor having a carbon oxide content of less than 1 volume percent.

5. A process as claimed in claim 1 in which the flame jet is a mixture substantially of oxygen and water vapor and has a carbon oxides content of less than 1 volume percent.

6. A process as claimed in claim 1 in which the flame jet is a mixture of oxygen, nitrogen and water vapor, and having a carbon oxides content of less than 1 volume percent.

7. A process as claimed in claim 5 in which the excess oxygen in the flame jet is between zero and approximately 60% by volume, the value depending on the stage of carbon removal and the composition of the steel in the converter.

8. A process as claimed in claim 1 in which the converter is acid-lined.

9. A process as claimed in claim 1 in which the water vapor flame jet is formed by the reaction of hydrogen and oxygen at the jetting orifice of a converter lance in which the hydrogen and oxygen are mixed upwardly of the jetting orifice of the lance.

10. A process as claimed in claim 1 in which the molten superheated metal is subjected to oxygen blowing through a channel in the lance prior to treatment with the water vapor flame jet to remove an initial quantity of carbon.

* * * * *